United States Patent [19]

Azuma

[11] Patent Number: 4,838,050

[45] Date of Patent: Jun. 13, 1989

[54] OPERATION MODE SELECTING DEVICE FOR WASHING MACHINES

[75] Inventor: Yoshiyuki Azuma, Nagoya, Japan

[73] Assignee: Kabushiki Kaisha Toshiba, Kawasaki, Japan

[21] Appl. No.: 25,721

[22] Filed: Mar. 13, 1987

[30] Foreign Application Priority Data

Nov. 21, 1986 [JP] Japan ..... 61-279018
Nov. 21, 1986 [JP] Japan ..... 61-279019
Nov. 21, 1986 [JP] Japan ..... 61-279020

[51] Int. Cl.[4] ..... D06F 33/02

[52] U.S. Cl. ..... 68/12 R; 68/207; 137/387

[58] Field of Search ..... 68/12 R, 207; 137/387

[56] References Cited

U.S. PATENT DOCUMENTS 4,184,347 1/1980 Tobita et al. ..... 68/12 R

FOREIGN PATENT DOCUMENTS 152357 11/1979 Japan ..... 68/12 R
37988 3/1984 Japan ..... 68/12 R
183407 10/1984 Japan ..... 68/12 R
162975 7/1986 Japan ..... 68/12 R
164591 7/1986 Japan ..... 68/12 R

*Primary Examiner*—Harvey C. Hornsby

*Assistant Examiner*—Stephen F. Gerrity

*Attorney, Agent, or Firm*—Foley & Lardner, Schwartz, Jeffery, Schwaab, Mack, Blumenthal & Evans

[57] ABSTRACT

This invention relates to an operation mode selecting device for washing machines, including a microcomputer consisting of a memory unit for storing data of operation courses each of which has different control processes from one another, data of water stream modes each of which has different control processes from one another and data of rinse modes each of which has different control processes from one another, and a central processing until (CPU) for performing one of the operation courses selected. The microcomputer is so programmed that when one of the water stream modes is selected with a stream mode selecting switch, one of the operation courses is automatically selected in accordance with the water stream mode selected. The microcomputer is also programmed so that wash and rinse modes intially selected by initial operation of the wash and rinse mode selecting switches are determined in accordance with the water stream mode selected. The microcomputer is further programmed so that operation of a clear switch is allowed while the operation of the washing machine is momentarily interrupted by operation of a start switch which serves to momentarily interrupt the operation of the washing machine.

4 Claims, 6 Drawing Sheets

OPERATION MODE SELECTING DEVICE FOR WASHING MACHINES

BACKGROUND OF THE INVENTION

1. Field of the Invention

The present invention relates generally to an operation mode selecting device for washing machines incorporating a microcomputer-based control circuit, and more particularly to such a device wherein operation modes of the washing machine are selected with switches provided on an operation panel thereof.

2. Description of the Prior Art

In the following description, a step refers to each of wash, rinse and water discharge operations and an operation course refers to combination of the aforesaid steps performed in a cycle of operation of the washing machine.

For example, prior art twin-tub washing machine incorporates a microcomputer-based control circuit and the steps of wash, rinse and so on are controlled on accordance with an operation course set in the control circuit with control process selecting switches. The control process selecting switches include a water stream mode selecting switch for setting strength of water stream in the wash and rinse modes, a wash mode selecting switch for selecting one of time periods of wash operation and a rinse mode selecting switch for selecting the number of the rinse operation times. Additionally, on the operation panel are provided a clear switch for clearing the selected operation course and a start switch for starting the selected operation course after the selection thereof, the start switch also serving for momentarily interrupting execution of the selected operation course.

Data of a plurality of water stream modes in which strength of water stream differs from one another, data of a plurality of wash modes which provide different control processes from one another and data of a plurality of rinse modes which provide different control processes from one another are stored at the microcomputer. The water stream modes include "STANDARD", "INTENSE," "MILD" and "GENTLE." The "STANDARD" water stream mode is suitable for the washing and rinsing of clothes having standard degree of soil, the "INTENSE" water stream mode for the washing and rinsing of the clothes extremely soiled, the "MILD" water stream mode for the washing and rinsing of the clothes slightly soiled and the "GENTLE" water stream mode for the washing and rinsing of the clothes damaged easily. The "STANDARD" water stream mode is automatically selected when the control circuit is initialized and the water stream mode is then changed from "STANDARD" to "INTENSE," "MILD," "GENTLE" and "STANDARD" in turn in accordance with the number of operation times of the water stream mode selecting switch.

The wash modes are based on execution time period of the washing operation and include "TEN MINUTES," "SEVEN MINUTES," "FIVE MINUTES," "TWO MINUTES," FIFTEEN MINUTES" and "TWELVE MINUTES." The "TEN MINUTES" wash mode is automatically selected when the control circuit is initialized. The wash mode is changed from "TEN MINUTES" to "SEVEN MINUTES," "FIVE MINUTES," "TWO MINUTES," "FIFTEEN MINUTES" and "TEN MINUTES" in turn in accordance with the number of operation times of the wash mode selecting switch.

The rinse modes are based on two manners of rinse operation, that is, an overflow rinse and a water reserve rinse, and the numbers of rinse operation times. A "STANDARD" rinse mode is suitable for the rinsing of the clothes containing average amount of detergent. An "ECONOMY" rinse mode is suitable for the rinsing of the clothes containing small amount of detergent. A "GENTLE" rinse mode is suitable for the rinsing of the clothes damaged easily. A "CAREFUL" rinse mode is suitable for the rinsing of the clothes containing a large amount of detergent. The "STANDARD" rinse mode is selected when the control circuit is initialized. The rinse mode is changed from "STANDARD" to "ECONOMY," "GENTLE," "CAREFUL" and "STANDARD" in turn in accordance with the number of operation times of the rinse mode selecting switch.

The operation course including steps selected with the water stream mode selecting switch, the wash mode selecting switch and the rinse mode selecting switch is started when the start switch is turned on.

In the overflow rinse, supply of water and discharge of overflow water occur while the water is being agitated. In the water reserve rinse, the water is not supplied while the water is being agitated.

As described above, in the case of the washing machine incorporating the microcomputer-based control circuit, the operation cycle of the washing machine is precisely controlled and the washing machine provides convenience in actual use. However, there are several problems to be solved. First, many switches are provided on the operation panel of the washing machine, so that the number of parts to be assembled is increased and the assembling work becomes complicated. Consequently, production cost of the washing machine is increased. Second, an operator is forced into troublesome switching operation when a desired wash or rinse mode is selected. For example, in the selection of the "TWELVE MINUTES" wash mode, since the "TEN MINUTES" wash mode is selected when the control circuit is initialized, the operator is required to operate the wash mode selecting switch five times to select the "TWELVE MINUTES" wash mode according to the order of selection. In the case of the selection of the rinse mode, the operator also meets such troublesome operation of the rinse mode selecting switch as in the selection of the wash mode. Third, the washing machine is provided with a clear switch for clearing the selected operation steps to reselect a new step. When the clear signal is supplied to the control circuit while the washing machine is being operated with a motor for wash operation running, the control circuit is adapted not to clear the step, thereby preventing the motor from undergoing sudden change in control. However, the clear action is performed if the control circuit is initialized after electrical power is supplied to the washing machine or after the operation cycle of the washing machine is completed. Consequently, for example, when the operator wants to change the action courses from the course including the wash and rinse steps to the course including only the wash step after the operation of the washing machine is started, the operation course is not cleared even if the operation of the washing machine is momentarily interrupted to clear the operation course. To avoid the above-described case, the power-supply switch is usually turned off and then turned on to thereby return the control circuit of the initial condition again. Thus, the operator is forced into troublesome operation of the switches.

SUMMARY OF THE INVENTION

It is, therefore, a first object of the present invention to provide an improved operation mode selecting device for washing machines wherein the number of switches provided on the operation panel is reduced.

To attain the first object, the operation mode selecting device for washing machines of the invention comprises a microcomputer-based control circuit including a central processing unit (CPU) and a memory unit at which a plurality of predetermined operation courses each course including wash and rinse steps and data of a plurality of water stream modes in which strength of water stream differs from one another. When one of the water stream modes is selected with a water stream mode selecting switch, one of the operation courses suitable for the selected water stream mode is also selected. Consequently, a switch for selecting the operation course is eliminated, thereby decreasing the assembly parts and providing easy operation of the switches.

It is a second object of the invention to provide an improved operation mode selecting device for washing machines wherein the number of switch operation times is reduced when a desired wash or rinse mode is selected among a plurality of wash or rinse modes.

To attain the second object, the memory unit is so programmed that the priority of order for selecting one of the wash and rinse modes is differentiated in accordance with a selected water stream mode. Consequently, when a desired water stream mode is selected, a wash or rinse mode suitable for the selected water stream mode is given top priority, thereby decreasing the number of switch operation times.

It is a third object of the invention to provide an improved operation mode selecting device for washing machines wherein the number of switch operation times is decreased when an operation course is changed to another after the operation of the washing machine is started.

To attain the third object of the invention, a start switch for starting the operation of the washing machine also serves as a switch for momentarilly interrupting the operation of the washing machine and the clear action is effected even when the operation of the washing machine is momentarilly interrupted. Consequently, the operation course can be changed with a start switch, the clear switch and a step selecting switch. Thus, ON-OFF operations of the power-supply switch are denecessitated when the operation course is changed to another after the operation of the washing machine is started, thereby decreasing the number of switch operation times.

Other and further objects of this invention will become obvious upon an understanding of the illustrative embodiment about to be described or will be indicated in the appended claims, and various advantages not referred to herein will occur to one skilled in the art upon employment of the invention in practice.

DETAILED DESCRIPTION OF A PREFERRED EMBODIMENT

Figure 1:
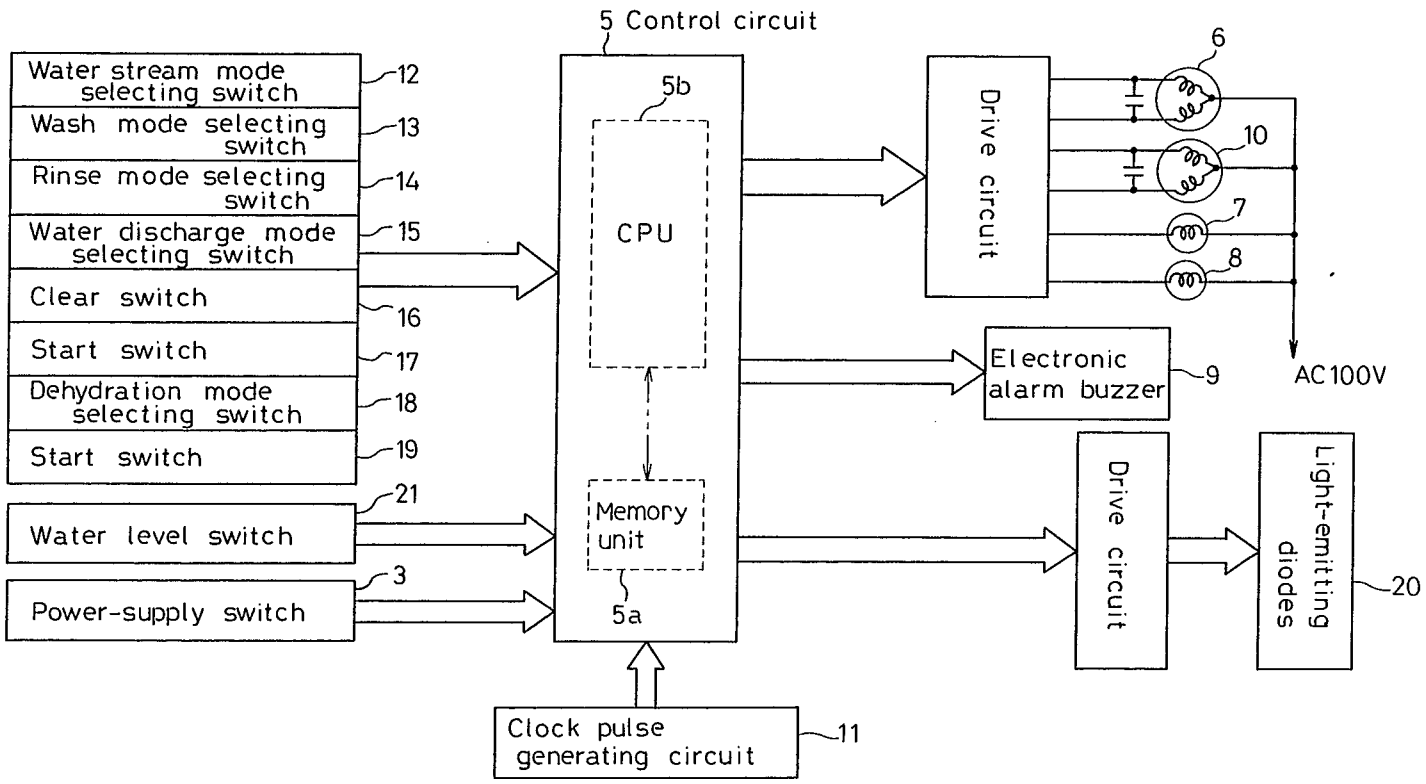
FIG. 1 is a block diagram showing electrical construction of the operation mode selecting device of the embodiment in accordance with the present invention.
Figure 2:
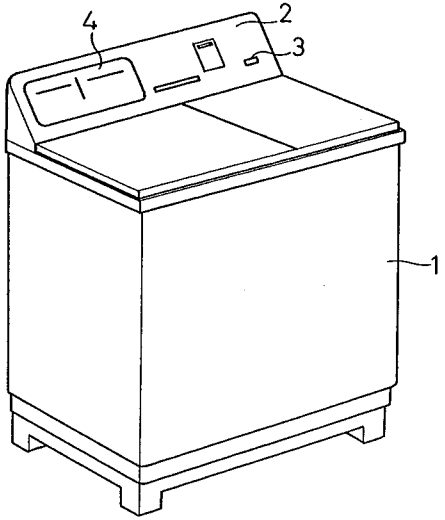
FIG. 2 is a persepective view of a washing machine incorporating the operation mode selecting device of the invention.

An embodiment, in which the operation mode selecting deivce of the present invention is applied to a twin-tub washing machine, will now be described with reference to the drawings. Referring first to FIG. 2, the twin-tub washing machine includes a cabinet 1 which encloses a wash tub and dehydrating basket in transverse disposition, both not shown. A control box 2 is mounted on the cabinet 1. A power-supply switch 3 and an operation panel 4 are provided on the control box 2. Referring to FIG. 1, a microcomputer-based control circuit 5 includes a memory unit 5*a* and a central processing unit (CPU) 5*b*. Numeral 6 indicates a washing motor for driving a pulsator provided within the wash tub. Numeral 7 indicates a water-supply walve for introducing water into the wash tub. Numeral 8 indicates a drain valve for discharging the water from the wash tub. Numeral 9 indicates an electronic alarm buzzer and numeral 10 indicates a dehydrating motor for driving a dehydrating basket. Numeral 11 indicates a clock pulse generating circuit which supplies the control circuit clock pulses. The control circuit 5 has a time counting function.

Data of water stream modes, wash modes and rinse modes are stored at the memory unit 5*a* of the control circuit 5.

First, the water stream modes will be described. The water stream modes are based on intensity of water stream. Four kinds of water stream modes are employed in the embodiment as shown in TABLE 1. Each kind of water stream mode depends on intermittent power-supply to the washing motor 6, that is, ON-time period (t1) and OFF-time period (t0) (second) of the power-supply circuit of the washing motor 6 as follows:

(A) "STANDARD" water stream mode:
$t1=1.3$, $t0=0.6$
(B) "INTENSE" water stream mode:
$t1=1.7$, $t0=0.6$
(C) "MILD" water stream mode:
$t1=0.8$, $t0=3.0$
(D) "GENTLE" water stream mode:
$t1=0.5$, $t0=1.8$ The wash modes are based on time period of the wash step and six kinds of wash modes are employed in the embodiment: "TEN MINUTES," "SEVEN MINUTES," "FIVE MINUTES," "TWO MINUTES,"

"FIFTEEN MINUTES" and "TWELVE MINUTES."

TABLE 1

| water stream modes | washing motor t1 (ON) | washing motor t0 (OFF) |
|---|---|---|
| "STANDARD" | 1.3 (second) | 0.6 (second) |
| "INTENSE" | 1.7 | 0.6 |
| "MILD" | 0.8 | 3.0 |
| "GENTLE" | 0.5 | 1.8 |

Four kinds of rinse modes employed in the embodiment are based on combination of manners of the rinse operation, the number of rinse operation times and time period of the rinse operation as shown in TABLE 2:

(E) "STANDARD" rinse mode:

A two minutes' water reserve rinse operation is performed twice with the "STANDARD" water stream mode selected and a five minutes' overflow rinse operation is performed once with the "STANDARD" water stream mode selected.

(F) "CAREFUL" rinse mode:

The two minutes' overflow rinse operation is performed with "INTENSE" water stream mode selected and the five minutes' overflow rinse operation is performed once with the "INTENSE" water stream mode selected.

(G) "ECONOMY" rinse mode:

The two minutes' water reserve rinse operation is performed once with "MILD" water stream mode selected and the three minutes' overflow rinse operation is performed once with "MILD" water stream mode selected.

(H) "GENTLE" rinse mode:

The three minutes' overflow rinse operation is performed once with "GENTLE" water stream mode selected.

Dehydration modes are based on execution time period of dehydration step and four kinds of dehydration modes are employed in the embodiment: "THREE MINUTES," "ONE MINUTE," "A QUARTER MINUTE" and "FIVE MINUTES."

TABLE 2

| Rinse modes | operation processes |
|---|---|
| "STANDARD" | "STANDARD" water stream mode; two minutes' water reserve rinse/twice; five minutes' overflow rinse/once |
| "CAREFUL" | "INTENSE" water stream mode; two minutes' overflow rinse/twice; five minutes' overflow rinse/once |
| "ECONOMY" | "MILD" water stream mode; two minutes' water reserve rinse/once; three minutes' overflow rinse/once |
| "GENTLE" | "GENTLE" water stream mode; three minutes' overflow rinse/once |

As shown in TABLE 3, data of four kinds of predetermined operation courses in accordance with the water stream modes, "STANDARD," "INTENSE," "MILD" and "GENTLE," are stored at the memory unit 5a of the control circuit 5. The four kinds of predetermined operation courses are described as follows:

(I) "STANDARD" predetermined operation course:

"STANDARD" water stream and "TEN MINUTES" wash modes are selected for the wash step and "STANDARD" rinse mode is selected for the rinse step. The water is discharged after the rinse step is executed and the operation cycle of the washing machine is completed.

(J) "INTENSE" predetermined operation course:

"INTENSE" water stream and "FIFTEEN MINUTES" wash modes are selected for the wash step and "CAREFUL" rinse mode is selected for the rinse step. The water is discharged after the rinse operation is executed and the operation cycle of the washing mahine is completed.

(K) "MILD" predetermined operation course:

"MILD" water stream and "FIVE MINUTES" wash modes are selected for the wash step and "ECONOMY" rinse mode is selected for the rinse step. The water is discharged after the rinse operation is executed and the operation cycle of the washing machine is completed.

(L) "GENTLE" predetermined operation course:

"GENTLE" water stream and "TWO MINUTES" wash modes are selected for the wash step and "GENTLE" rinse mode is selected for the rinse step. The water is discharged after the rinse operation is executed and the operation cycle of the washing machine is completed.

TABLE 3

| water stream modes | predetermined operation courses | wash steps: water stream modes | wash steps: wash modes | rinse steps rinse modes | final water discharge | dehydration modes |
|---|---|---|---|---|---|---|
| "STANDARD" | "STANDARD" | "STANDARD" | "TEN MINUTES" | "STANDARD" | EXECUTE | "THREE MINUTES" |
| "INTENSE" | "INTENSE" | "INTENSE" | "FIFTEEN MINUTES" | "CAREFUL" | EXECUTE | "FIVE MINUTES" |
| "MILD" | "MILD" | "MILD" | "FIVE MINUTES" | "ECONOMY" | EXECUTE | "ONE MINUTE" |
| "GENTLE" | "GENTLE" | "GENTLE" | "TWO MINUTES" | "GENTLE" | EXECUTE | "A QUARTER MINUTE" |

In each predetermined operation course, the water stream mode in the rinse step is the same as that in the wash step. It should be noted that the predetermined operation courses depend on intensity of the water stream and that each of the wash and rinse modes of each predetermined operation course is determined to have specific execution time period pattern and pattern of the number of execution times in accordance with the intensity of the water stream. Consequently, the clothes are effectively prevented from damage, and an amount of water supplied for the rinse operation and the time period required for the operation cycle of the washing machine are economized.

Figure 3:
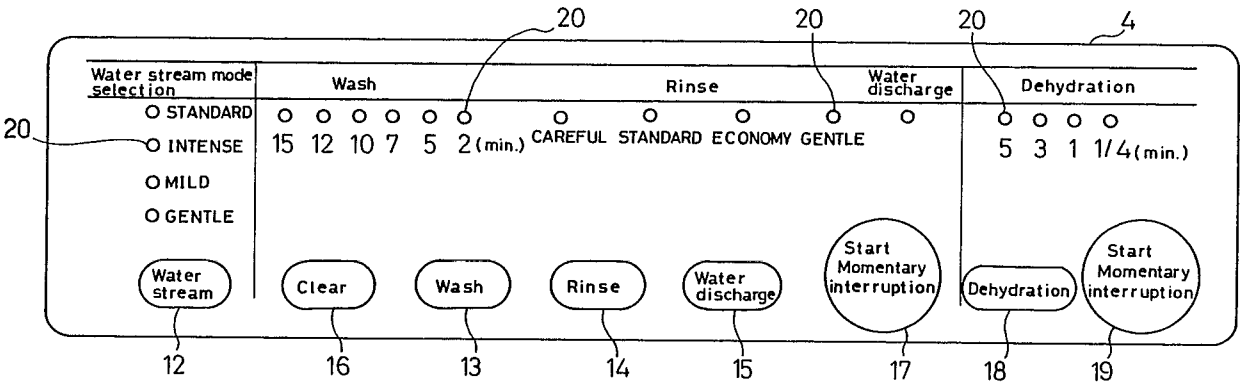
FIG. 3 is a front view of an operation panel of the washing machine in FIG. 2.

Referring now to FIGS. 1 and 3, numeral 12 indicates a switch for selecting a water stream mode. Numeral 13 indicates a switch for selecting a wash mode (as a step mode selecting switch). Numeral 14 indicates a switch for selecting a rinse mode (as a step mode selecting switch). Numeral 15 indicates a switch for selecting a water discharge mode and numeral 16 indicates a clear switch. Numeral 17 indicates a start switch for starting the operation of the washing machine. The start switch 17 also serves as a switch for momentarily interrupting the wash operation. Numeral 18 indicates a switch for selecting a dehydration mode (as a step mode selecting switch). Numeral 19 indicates a switch for starting the dehydration operation. The switch 19 also serves as a switch for momentarily interrupting the rinse operation. Each of the switches 12–19 is formed into a push switch of the self-return type. Light-emitting diodes 20 display respective modes selected with the switches 12–19. Numeral 21 indicates a water level switch.

When the switch 17 is turned on while the control circuit is initialized with the power-supply switch 3 turned on or with the operation cycle of the washing machine completed, the operation of the washing machine is started. When the switch 17 is turned on while the washing machine is operated, the operation thereof is momentarily interrupted. The operation of the washing machine is restarted when the switch 17 is again turned on while the operation of the washing machine is momentarily interrupted. When the start switch 17 is turned on, the steps of the predetermined operation course selected at the time of the selection of the water stream mode is not changed to another. The steps of the selected operation course can only be changed by operation of the switches including the one for momentarily interrupting the operation of the washing machine, as will be described hereafter. On the other hand, since the selected water stream, wash, rinse and water discharge modes are not fixed, these modes can be changed to others with the switches 12, 13, 14 and 15 respectively before and after the start of the operation of the washing machine. In this case, elimination of the steps is not allowed. The start switch 19 for the dehydration operation functions in the same manner as the start switch 17.

When the clear switch 16 is turned on, the clear signal is supplied to the control circuit 5. The control circuit 5 is so programmed that the clear operation is performed when the clear signal is supplied thereto while the operation of the washing machine is momentarily interrupted where the control circuit 5 is initialized with the power-supply switch 3 turend on or with the operation cycle of the washing machine completed. When the clear signal is supplied to the control circuit 5 under the above-described condition, all the selected modes except the water stream mode, that is, the wash, rinse, dehydration and water discharge modes are cleared. Consequently, the light-emitting diodes 20 displaying the selected modes are extinguished.

Figure 4A:
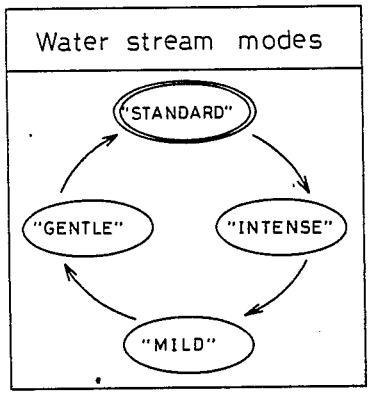
FIG. 4*a* through 4*d* are views employed to explain the order of priority in the case of selecting a water stream mode, a wash mode, a rinse mode and a dehydration mode.

Operation of the control circuit 5 in relation to the switches 12–19 will now be described. (I) Selection of a predetermined operation course When the control circuit 5 is initialized with the power-supply switch 3 turned on, the control circuit 5 operates to select the "STANDARD" water stream mode. To change the water stream mode from "STANDARD" to another, the water stream mode selecting switch 12 is turned on at desired times. As shown in FIG. 4*a*, the water stream mode is changed from "STANDARD" to "INTENSE" when the switch 12 is operated once. Afterwards, the water stream mode is changed from "INTENSE" to "MILD," "GENTLE" and "STANDARD" in turn every time when the switch 12 is operated. The control circuit 5 operates to select one of the predetermined operation courses in accordance with the selected water stream mode as shown in TABLE 3. Accordingly, the predetermined operation course to be selected is changed to "INTENSE," "MILD," "GENTLE" and "STANDARD" in turn every time when the switch 12 is operated. Simultaneously, the execution time period of the dehydration operation is also changed to "ONE MINUTE," "A QUARTER MINUTE," "FIVE MINUTES," and "THREE MINUTES" in turn every time when the switch 12 is operated, as shown in TABLE 3. In this embodiment, the dehydration mode is changed to "THREE MINUTES," "FIVE MINUTES," "ONE MINUTE" and "A QUARTER MINUTE" in turn when the water stream mode is changed from "STANDARD" to "INTENSE," "MILD," and "GENTLE" in turn. This control manner is effective in the case of the twin-tub washing machine in which the wash and dehydration operations are simultaneously performed and, particularly, an automatic washing machine in which a single tub is used for the wash operation and the centrifugal dehydration operation.

As described above, one of the predetermined operation courses suitable for the selected water stream mode is automatically selected as shown in TABLE 3.

When the start switch 17 is turned on, the operation of the washing machine is started in accordance with the selected predetermined operation course. Operation of the water-supply valve 7, the wash motor 6, the drain valve 8 and so on are controlled.

According to this invention, since the water stream mode selecting switch 12 also serves as a switch for selecting the predetermined operation course, thereby denecessitating provision of an exclusive switch for selecting the predetermined operation course. Consequently, the number of the switches is reduced and arrangement of the switches on the operation panel is simplified. Furthermore, the number of parts to be assembled is decreased. Accordingly, since the number of switches is decreased, operation of the switches is simplified.

(II) Establishment of quasi-predetermined operation course

The water stream is automatically determined in each predetermined operation course as shown in TABLE 3. The water stream, wash and rinse modes in each predetermined operation course can be changed to other desirable modes by operation of the switches 12, 13 and 14, thereby establishing a quasi-predetermined operation course.

For example, when the operator desires to change the water stream mode from "STANDARD" in "STANDARD" predetermined operation course to "INTENSE," the operation of the washing machine is started by operation of the start switch 19 in accordance with the "STANDARD" mode of the predetermined operation course selected in the initial condition of the control circuit. Then, during a first water-supply operation, the water stream mode selecting switch 12 is turned on once to thereby change the water stream mode from "STANDARD" to "INTENSE." Consequently, the wash and rinse operations are performed in accordance with "INTENSE" water stream mode afterwards. Thus, the water stream mode in each predetermined operation course can be changed by operating the water stream mode selecting switch 12 after the start switch 17 is operated. Similarly, the wash or rinse mode in the selected predetermined operation course can be changed by operating the switch 13 or 14 after the operation of the washing machine is started in accordance with the selected predetermined operation course.

(III) Mode selection order

Mode selection order on which the water stream, wash and rinse modes in each predetermined operation course are changed by operation of the switches 12–14 in relation to the water stream mode is programmed in the control circuit 5. The priority of order in the selection of the water stream mode with the switch 12 is shown by arrows in FIG. 4*a*. In the initial condition of the control circuit 5, the "STANDARD" stream mode is selected, so that the "TEN MINUTES" wash mode and the "STANDARD" rinse mode are also selected without operation of the switches 13 and 14, as shown in TABLE 3. As described above, when the water stream mode is changed from "STANDARD" to "INTENSE," "MILD," and "GENTLE" in turn by operation of the switch 12 in the case where the control circuit 5 is initialized, the wash, rinse and dehydration modes are changed as shown in TABLE 3.

Figure 6:
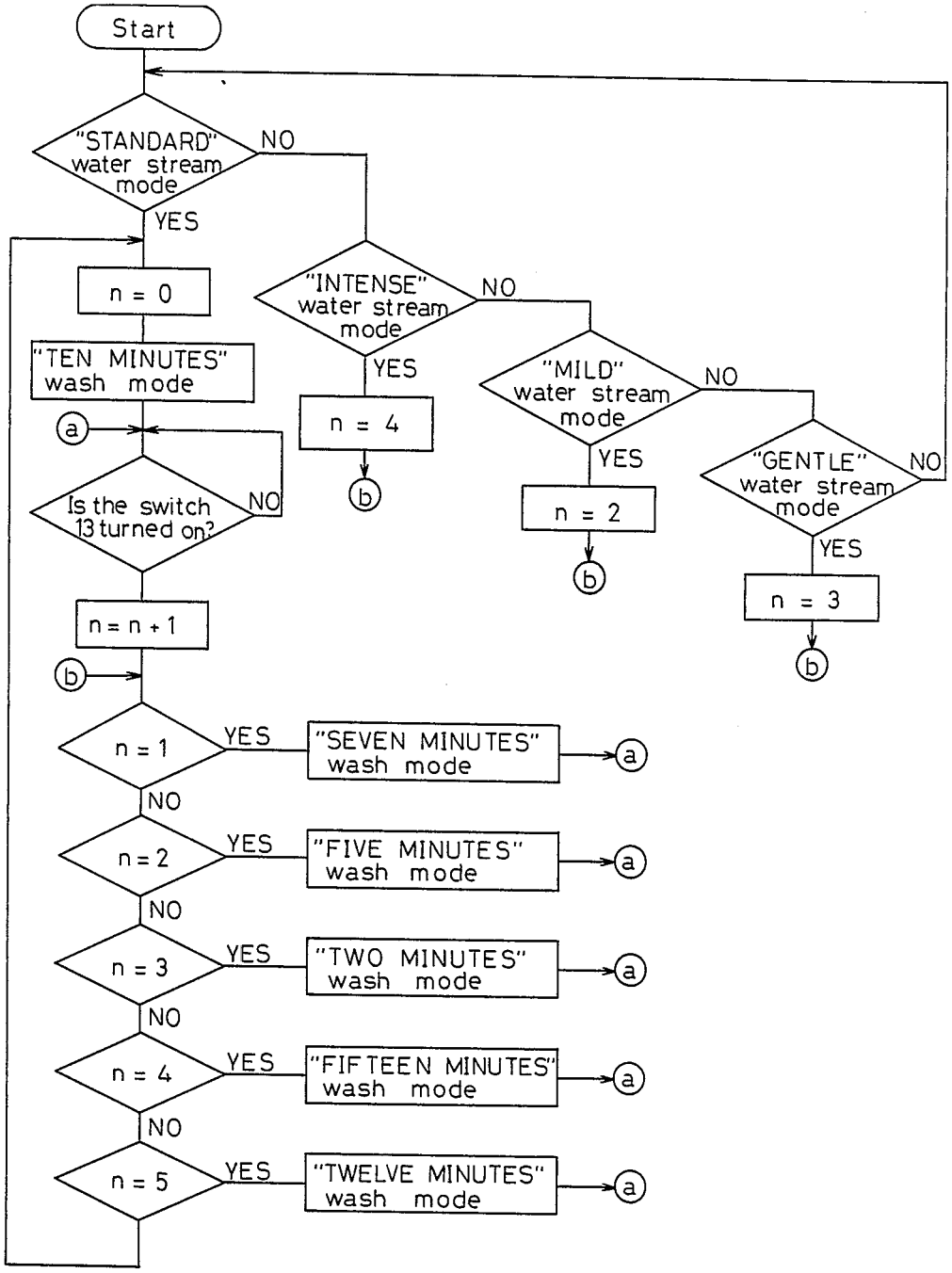
FIG. 6 is a flow chart showing part of progress of the operation for giving top priority to one of wash modes to be selected.
Figure 7:
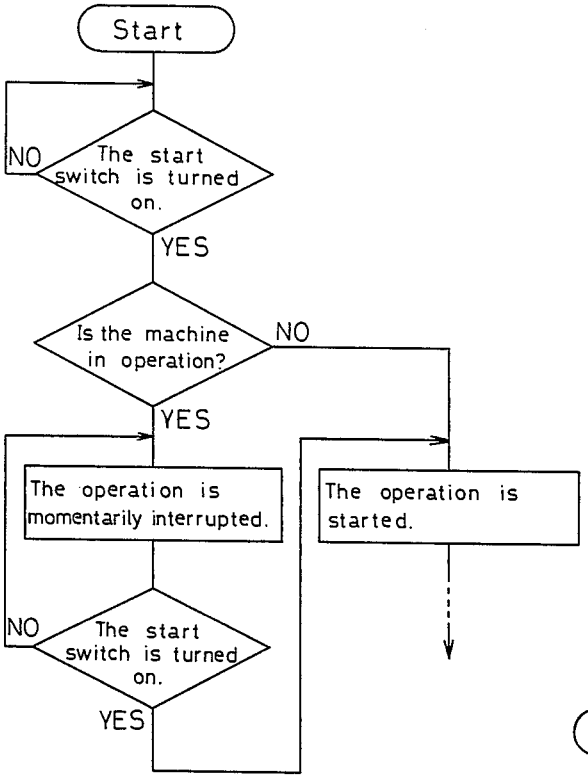
FIG. 7 is a flow chart showing progress of the operation to momentarily interrupt the operation of the washing machine.
Figure 8:
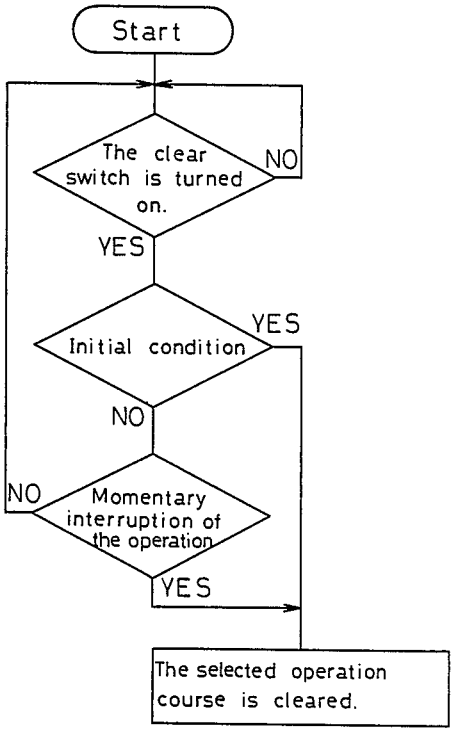
FIG. 8 is a flow chart showing progress of the clear operation.

The wash and rinse modes initially selected by an initial operation of the switches 13 and 14 are automatically determined in accordance with the water stream mode which is selected when the wash and rinse modes is to be selected, as shown in FIG. 6. Although FIG. 6 shows the case of the wash mode, the rinse mode is selected in the same manner. The wash and rinse modes selected by the initial operation of the switches 13 and 14 are changed from the modes shown in TABLE 3 to those in the direction of arrows in FIGS. 4*b* and 4*c* respectively. Accordingly, where the "STANDARD" water stream mode and the "ECONOMY" rinse mode are selected. Where the "INTENSE" water stream mode is selected, "TWELVE MINUTES" wash mode and the "STANDARD" rinse mode are selected. When the water stream mode is "MILD," "TWO MINUTES" wash mode and "GENTLE" rinse mode are selected. When the water stream mode is "GENTLE," "FIFTEEN MINUTES" wash mode and "CAREFUL" rinse mode are selected.

Figure 4B:
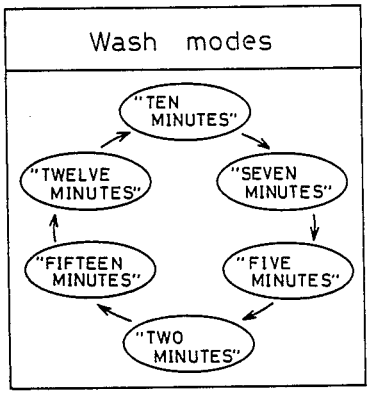
Figure 4C:
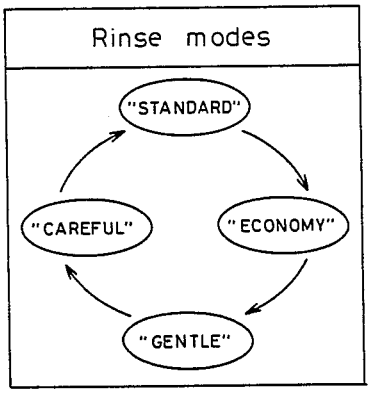
Figure 4D:
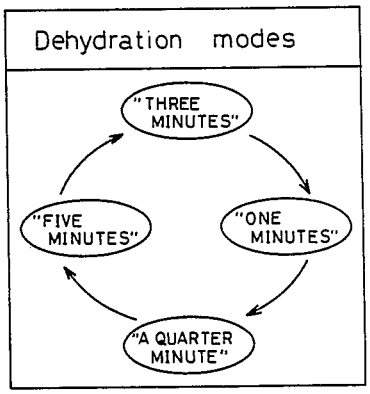
Figure 5:
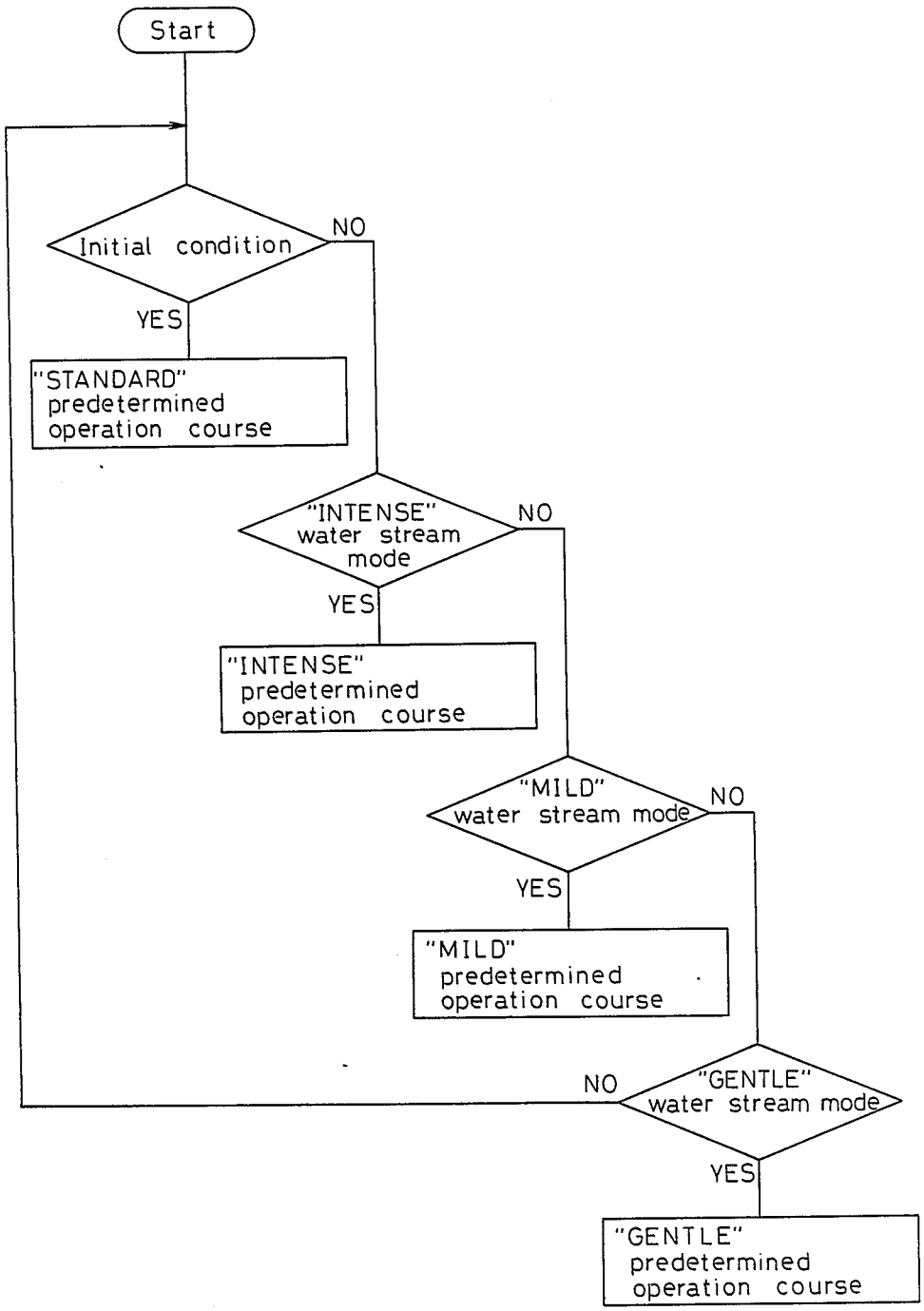
FIG. 5 is a flow chart showing progress of the operation for selecting a predetermined operation course.

When the wash and rinse modes selecting switches 13 and 14 are operated at a second time, the modes given top priority are changed to those in FIGS. 4*b* and 4*c* forwarded by one step in the direction of arrows from the modes selected by the initial operation of the switches 13 and 14. In the case of further operation of the switches 13 and 14, the modes given the top priority are changed to those forwarded by every one step in the direction of arrows respectively. The priority of order for the selection of the wash and rinse modes is determined so as to accord with the frequency of use of the modes relative to the selected water stream mode or with the order suitable for the wash operation. The dehydration mode is also selected with the switch 8 in accordance with the same priority of order as described above, as shown in FIG. 4*d* and TABLE 3.

Thus, the desired modes are selected by operation of the switches 12–14 and, if necessary, the switch 18 to thereby establish a newly programmed operation course. After the new operation course is established, the operation of the washing machine is performed in accordance with the new operation course when the start switch 19 is turned on.

The control circuit 5 is so programmed that the priority of order for selecting the wash and rinse modes accords with the high frequency of use in relation to the selected water stream mode or with the order suitable for the wash operation as much as possible. Consequently, the number of operation of the switches required for the selection of the wash, rinse and dehydration modes is effectively reduced.

(IV) Change of steps after start of the operation of washing machine

The steps of the selected operation course can be changed in the following manner after the desirable operation course including wash and rinse steps is selected, thereby starting the operation of the washing machine by operation of the start switch 19. First, the start switch 19 is operated to momentarily interrupt the operation of the washing machine. The clear switch 16 is then operated to clear all the selected steps. The wash or rinse step is selected by operation of the switch 13 or 14 together with the desirable mode thereof. The start switch 19 is again operated to restart the operation of the washing machine in accordance with a newly selected operation course.

As described above, the clear action is effected when the clear signal is supplied to the control circuit 5 while the operation of the washing machine is momentarily interrupted. Accordingly, even after the operation of the washing machine is started, the operation course can be changed to another by momentarily interrupting the operation of the washing machine with the clear switch 16 and by operating the switches 13 and 14. In this case, the operator is not required to turn off the power-supply switch 3 and to turn it on again. Consequently, addition or elimination of the steps can easily be done.

In the twin-tub washing machine, particularly, the wash and dehydration operations are sometimes performed simultaneously. In this case, when the power-supply switch is turned off so that the wash operation course may be changed to another, the dehydration operation is also interrupted unnecessarily. However, according to the operation mode selecting device of this invention, the wash operation course can be changed to another without turning off the power-supply switch 3, so that the dehydration operation is not interrupted. (V) Selection of a special operation course This function of the control circuit 5 is well known in the art. However, this function will be described to explain the clear switch 16. As described above, all the modes of the selected operation course except the water stream mode can be changed by operation of the clear switch 16. Then, either one of the wash, rinse, water discharge and dehydration steps may be selected by operation of either one of the switches 13-14 and 18 or combination of the water discharge step with either one of the wash and rinse steps may be selected.

When the operation course including the wash step of "FIFTEEN MINUTES" wash mode and not including the water discharge operation is selected, the switch 13 is operated at suitable times to select the "FIFTEEN MINUTES" wash mode after the clear switch 16 is operated. Furthermore, the water discharge selecting switch 15 is operated to select a "NO WATER DISCHARGE" mode.

The foregoing disclosure and drawings are merely illustrative of the principles of this invention and are not to be interpreted in a limiting sense. The only limitation is to be determined from the scope of the appended claims.

What is claimed is:

1. An operation mode selecting device for washing machines comprising:

(a) a microcomputer-based control circuit comprising a memory unit for storing data of a plurality of water stream modes wherein water stream strength differs from one another, data of at least three wash modes which have different control processes from one another, data of a plurality of rinse modes which have different control processes from one another, and data of a plurality of predetermined operation courses which have different control processes from one another and each of which includes wash and rinse steps, and a central processing unit for controlling a selection predetermined operation course;

(b) a manually operated switch for selecting one of the water stream modes, the data of which are stored in said memory unit;

(c) a manually operated push switch for sequentially selecting one of the wash modes, the data of which are stored in said memory unit, every time when manually operated, so that the wash mode set for the wash step of the selected predetermined operation course may be changed;

(d) a manually operated push switch for sequentially selecting one of the rinse modes, the data of which are stored in said memory unit, every time when manually operated, so that the rinse mode set for the rinse step of the selected predetermined operation course may be changed;

(e) means provided in said control circuit for automatically selecting one of the predetermined operation courses which has a predetermined relation to the water stream modes when one of the water stream modes is selected with said water stream mode selection switch; and (f) first preferential selection means for changing the wash mode initially selected by first operation of said wash node selecting switch in accordance with the selected water stream mode.

2. An operation mode selecting device for washing machines as defined by claim 1, wherein the data of the rinse modes stored in said memory unit includes data of at least three rinse modes and which further comprises second preferential selection means for changing the rinse mode initially selected by first operation of said rinse mode selecting switch in accordance with the preselected water stream mode.

3. An operation mode selecting device for washing machines comprising:

(a) a switch for selecting one of a plurality of water stream modes;

(b) a switch for selecting one of a plurality of wash modes;

(c) a switch for selecting one of a plurality of rinse modes; and (d) a microcomputer-based control circuit comprising:

a memory unit for storing (1) data of a plurality of water stream modes wherein water stream strength differs from one another, the water stream modes being selected with said water stream mode selecting switch, (2) data of at least three wash modes which have different control processes from one another, the wash modes being selected with said wash mode selecting switch, (3) data of a plurality of rinse modes which have different control processes from one another, the rinse modes being selected with said rinse mode selecting switch, a central processing unit for controlling an operation course including the water stream mode, wash and rinse modes selected with said water stream mode selecting switch, said wash mode selecting switch and said rinse mode selecting switch respectively, and a first preferential selection means for changing the wash mode initially selected by first operation of said wash mode selecting switch in accordance with the selected water stream mode.

4. An operation mode selecting device for washing machines as defined by claim 3, wherein the data of the rinse modes stored in said memory unit includes data of at least three rinse modes and which further comprises a second preferential selection means for changing the rinse made initially selected by first operation of said rinse mode selecting switch in accordance with the selected water stream mode.

* * * * *